United States Patent [19]

Bond

[11] Patent Number: 4,846,056

[45] Date of Patent: Jul. 11, 1989

[54] PRESS DWELL LINKAGE

[76] Inventor: Irvin D. Bond, 1027 Allen Rd., Clarkston, Mich. 48016

[21] Appl. No.: 134,380

[22] Filed: Dec. 17, 1987

[51] Int. Cl.[4] ..... B30B 1/26

[52] U.S. Cl. ..... 100/281; 72/421; 100/263; 100/292

[58] Field of Search ..... 100/216, 263, 280, 282, 100/291, 292, 281; 72/346, 450, 452, 421 X; 74/110

[56] References Cited

U.S. PATENT DOCUMENTS

| | | | |
|---|---|---|---|
| 226,998 | 4/1880 | Groom | 100/282 |
| 444,755 | 1/1891 | Casse et al. | 100/292 |
| 2,314,123 | 3/1943 | Butterfield | 72/427 |
| 3,080,983 | 3/1963 | Blatt | 72/426 |
| 3,209,922 | 10/1965 | Melvin | 72/421 |
| 3,349,602 | 10/1967 | Nelson | 72/426 |
| 4,513,602 | 4/1985 | Sofy | 72/421 |
| 4,637,243 | 1/1987 | Bond | 72/421 |
| 4,730,477 | 3/1988 | Redman | 72/346 |

FOREIGN PATENT DOCUMENTS

| | | | |
|---|---|---|---|
| 158672 | 3/1904 | Fed. Rep. of Germany | 100/292 |

*Primary Examiner*—Harvey C. Hornsby
*Assistant Examiner*—Corinne M. Reinckens
*Attorney, Agent, or Firm*—Charles W. Chandler

[57] ABSTRACT

A press apparatus mechanical dwell linkage comprises a pair of cam plates, one of which is fixed and the other pivotable, positioned in side-by-side parallel relationship. An operating arm is connected to the moving die in a press apparatus and simultaneously engages cam slots in each cam plate to transmit cam slot curvature and direction in the fixed cam to pivoting motion of the pivotable cam. A workpiece manipulating link oscillates with said pivotable cam to transversely change the position of a workpiece between the dies. The cam slots cooperate to introduce a dwell period in the work manipulating link at the start of, and end of, its workpiece-changing motion.

10 Claims, 3 Drawing Sheets

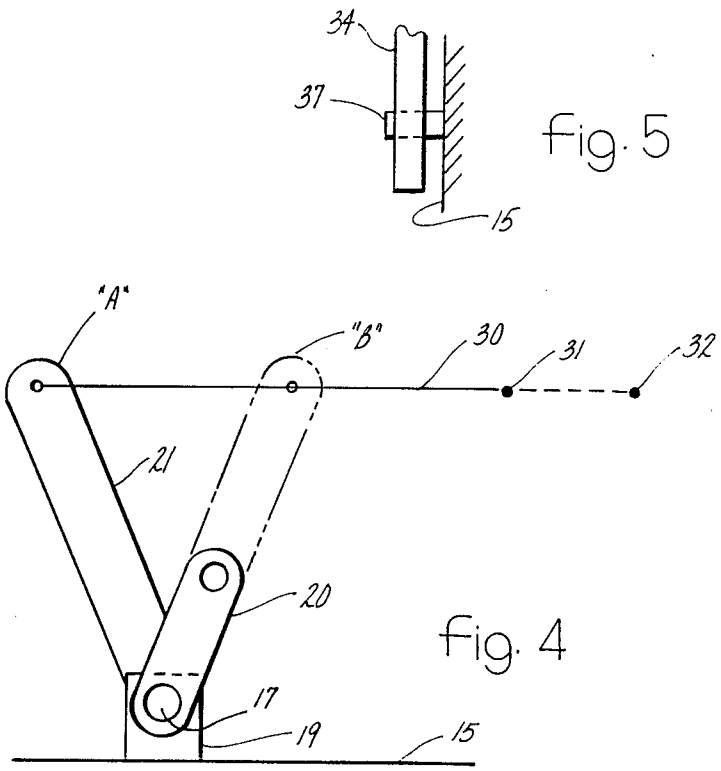
Fig. 4
Fig. 5
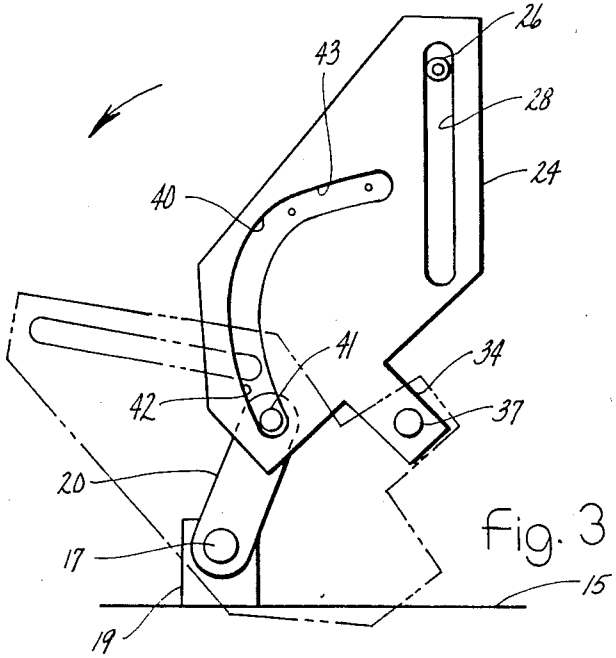
Fig. 3

PRESS DWELL LINKAGE

BACKGROUND OF THE INVENTION

This invention relates to a dwell linkage for a press apparatus, and more particularly to a mechanical linkage assembly operated by the moving die of a press to perform a work function on an object engaged by the dies. The linkage provides a positive and direct controlled movement of a link arm along a line perpendicular to the die's motion.

DESCRIPTION OF THE PRIOR ART

A well known kind of press apparatus comprises a moveable die or ram which moves vertically towards and away from a stationary die or platen. A workpiece is placed on the stationary die and is engaged by the moving die to form a stamping according to the die shape.

In manufacturing processes, such presses operate in a rapid manner. Automatic means are directly connected to a vertically moving die to insert, withdraw or adjust the position of a workpiece during the die cycle. One such automatic means in the form of a mechanical linkage assembly is disclosed and the form of a mechanical linkage assembly is disclosed and described in U.S. Pat. No. 4,637,243 which issued to Irving D. Bond which issued to Irvin D. Bond, Jan. 20, 1987. A desirable feature in the Bond linkage is its provision of a dwell or delay period in the linkage which provides an additional increment of time for the linkage to provide a further function during the press cycle. Dwell time or delay time may be described as a short period of time or travel by a vertically moving die which is accommodated without a corresponding output movement by the linkage.

OBJECTS OF THE INVENTION

Accordingly, it is an object of this invention to provide an improved mechanical linkage assembly which may be connected to a vertically reciprocating die in a press apparatus to convert a part of the die motion to a horizontal movement of the linkage towards and away from the die with a predetermined dwell period at the start of and end of the horizontal movement.

Another object of this invention is to provide an improved mechanical linkage assembly connected to a moving die of a press apparatus operative to convert part of the die movement to a transverse movement of the linkage towards and away from a workpiece position between the dies, by incorporating cam slots and rollers in the linkage to provide a dwell time at the start and end of the transverse movement.

It is another object of this invention to provide a linkage mechanism for connection to a press apparatus wherein a single link member engages a pair of cam surfaces to provide two dwell periods in a cycle of operation of the linkage mechanism.

SUMMARY OF THE INVENTION

A preferred mechanical linkage assembly is interconnected in a press apparatus having a pair of die members one of which moves in a reciprocating motion towards and away from the other die. The linkage utilizes a pair of spaced parallel cam plates. One cam plate is fixed and the other is movable. The cam plates have opposed cam slots. A single operating link of the linkage assembly is connected to the moving die and has a pair of cam rollers, each engaging the slots of the cam plates. The motion of the operating link and its roller in the cam slot of the fixed cam moves the moveable cam and a pair of levers in a motion having a dwell period at the beginning and end of the drive motion.

These and other objects and advantages of this invention will be better understood when taken in connection with the following detailed description and drawings.

DESCRIPTION OF THE DRAWINGS

The description refers to the accompanying drawings in which like reference characters refer to like parts throughout the several views, and in which:

FIG. 3 is a view as seen along lines 3—3 of FIG. 1;

FIG. 4 is a view as seen along lines 4—4 of FIG. 1; and

FIG. 5 is a fragmentary view as seen along lines 5—5 of FIG. 3.

FIGS. 6 through 9 show the condition of the cam assembly at different points during the downstroke of an associated movable die.

DESCRIPTION OF THE PREFERRED EMBODIMENT

Figure 1:
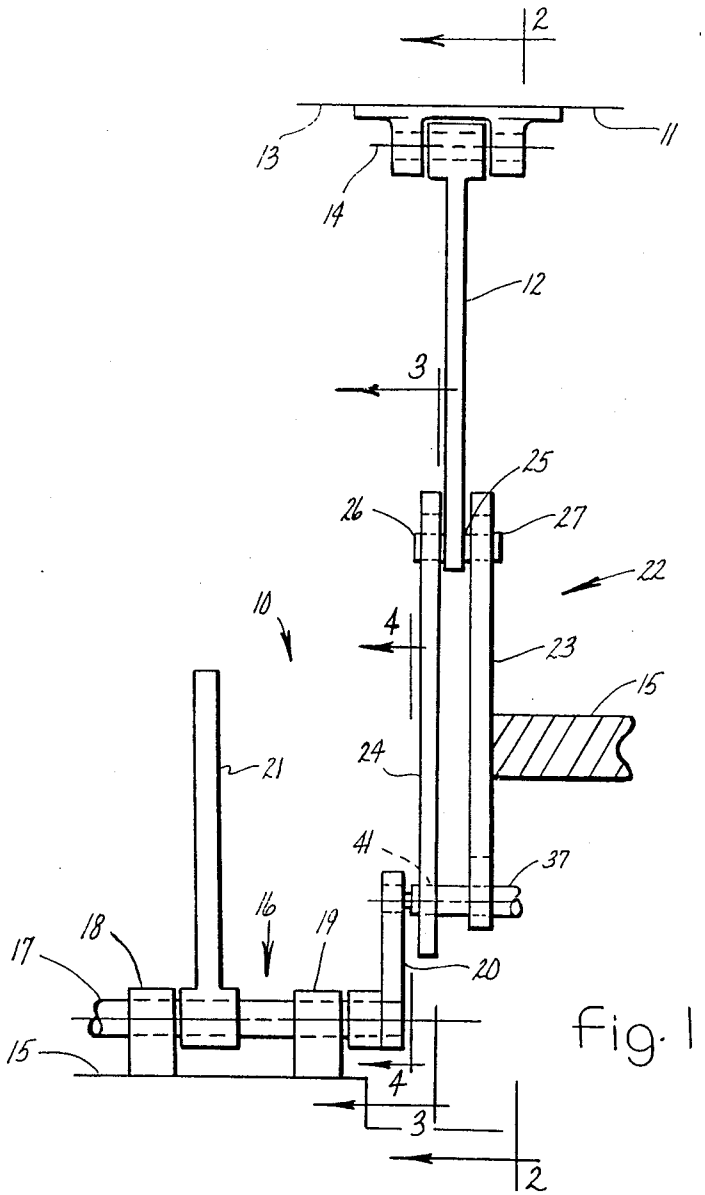
FIG. 1 is an end elevational view of a preferred linkage assembly illustrating the preferred embodiment of the invention.

Referring to FIG. 1, dwell linkage 10 is connected to a press apparatus 11 through an operating arm 12. The upper end of arm 12 is pivotally connected to a vertically moving ram or die 13 by a pivot connection 14. The lower end of the arm is connected to a lower fixed die 15 through a pivot and shaft assembly 16. Pivot and shaft assembly 16 comprises a shaft 17 rotatably mounted on die 15 by spaced journals 18 and 19. A crank arm 20 is carried on shaft 17 to oscillate with shaft 17.

Drive arm 21 is the manipulating arm of link assembly 10 and oscillates as shown in FIG. 4 between a first position at "A" and a second position shown in phantom at "B". Drive arm 21 is spaced from crank arm 20 and also fixed to shaft 17.

Referring to FIG. 1, a dual cam assembly 22 provides a driving connection between operating arm 12 and drive arm 21. Dual cam assembly 22 comprises a fixed cam plate 23, attached to lower die 15, and a pivotal cam plate 24. The two cam plates are in side-by-side, spaced, parallel relationship. Cam plates 23 and 24 are positioned between drive arm 20 and operating arm 12. The lower free end of arm 12 extends between cam plates 23 and 24. The lower end of arm 12 has a transverse shaft 25 to provide an inverted "T" configuration with shaft 25 being the cross member of the "T". Cam rollers 26 and 27 are mounted on opposite ends of shaft 25. Camrroller 26 is received in a cam slot 28 in ccam 24, and cam roller 27 is receivedin a cam slot 29 in fixed cam 23.

A further link may ee connected to arm 21 (as shown by the dashed line 30 in FIG. 4) to move a workpiece from a position indicated at 31, to a position indicated at 32. The generic link represeneed by dashed line 30 may be a workpiece manipulating link such as a workpiece extraction arm or a workpiece position changer. Aforementioned U.S. Pat. No. 4,637,243 shows a workpiece manipulating mechanism (at 42, 40, 28) that could be used to perform the function represented by dashed line 30 in the attached drawings.

Referring to FIG. 3, cam plate 24 includes a peripheral extension 34 pivotally mounted on a pivot pin or shaft 37 mounted on fixed die 15, as shown in FIGS. 3 and 5.

Referring again to FIGS. 2 and 3, slot 28 is a straight line vertical slot whose longitudinal axis is parallel to the line of motion 35 of die 13. Slot 29 in cam plate 23 has a pair of connected slot sections 38 and 39. Slot section 38 coincides with slot 28 and is directly opposite thereto. Slot section 39 is disposed at an obtuse angle relative to slot section 38, and joins slot section 38 in a smooth curve. Accordingly, cam roller 27 moves smoothly along slot section 38 and into angular section 39.

Referring to FIGS. 1 and 3, shaft 17 projects beyond journal 19. Cam plate 24 has a cam slot 40. A cam roller 41 is transversely positioned on crank arm 20 to fit in cam slot 40.

Cam slot 40, as illustrated in FIG. 3, is an arcuate slot comprising a section 42 of a predetermined radius and an end section 43 of a greater radius.

As cam plate 24 pivots about shaft 37 in a counterclockwise direction, as shown in FIG. 3, the side slot 40 bears against roller 41 to rotate crank arm 20 and shaft 17 in the counterclockwise direction. By an appropriate design and arrangement of slots and rollers, the dual cam plate assembly converts reciprocating, linear motion of die 13 to oscillating motion of crank arm 20 and drive arm 21.

Figure 2:
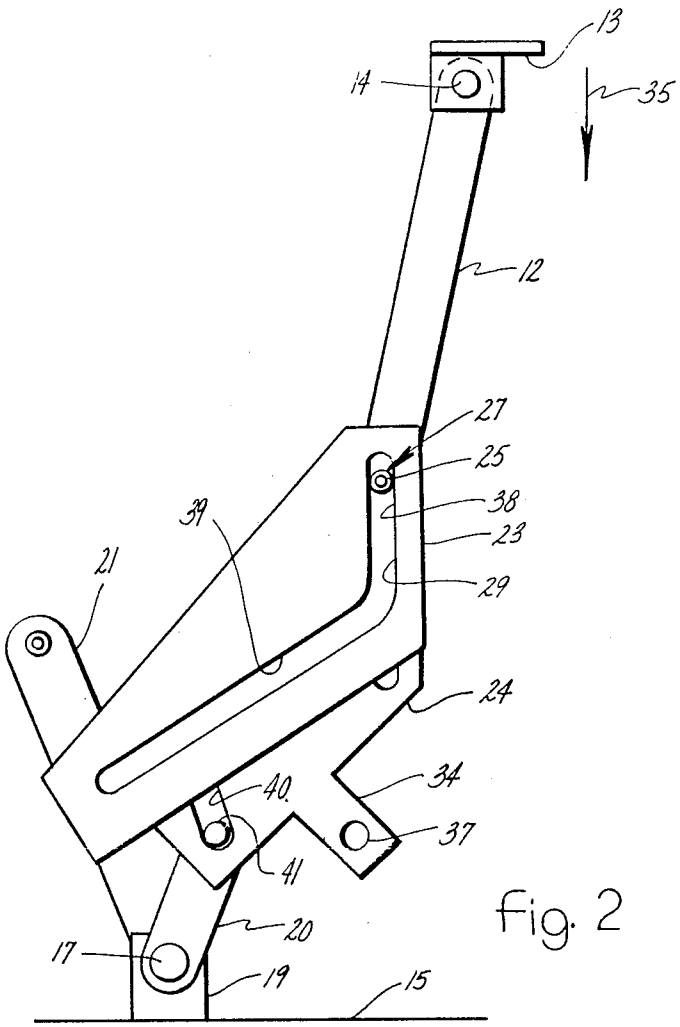
FIG. 2 is a side elevational view of the link assembly of FIG. 1 taken along lines 2—2 thereof.
Figure 6:
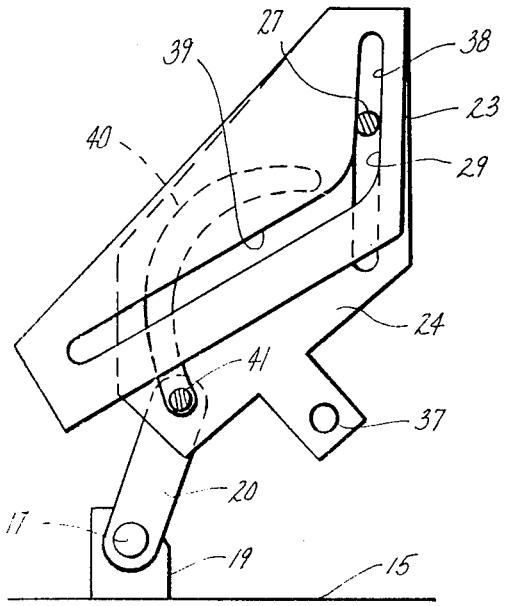
FIGS. 6 through 9 are side elevational views of dual cam assembly forming part of the FIG. 1 linkage assembly.

Referring to FIG. 2, linkage assembly 10 is illustrated, for description purposes as connected to upper die 13 which moves in a straight vertical line 35, towards and away from die 15 in a reciprocating action. Linkage assembly 10 is readily adaptable to press apparatus which perform pressing operations in the horizontal as well as intermediate directions. A half cycle of the reciprocating action may be described as the movement of die 13 from its uppermost position to its lowermost position. During a half cycle, linkage 10 operates as follows. As die 13 moves towards die 15, operating arm 12 commences a downward movement. Cam rollers 26 and 27 on arm 12 move in their respective slots 28 and 29. However, since slot section 38 and slot 28 are identical with longitudinal axes parallel to the straight line motion of die 13, die 13 does not pivot cam 24. This occurrence represents a dwell action in the beginning part of the downward stroke of die 13, as illustrated in FIG. 6.

Figure 7:
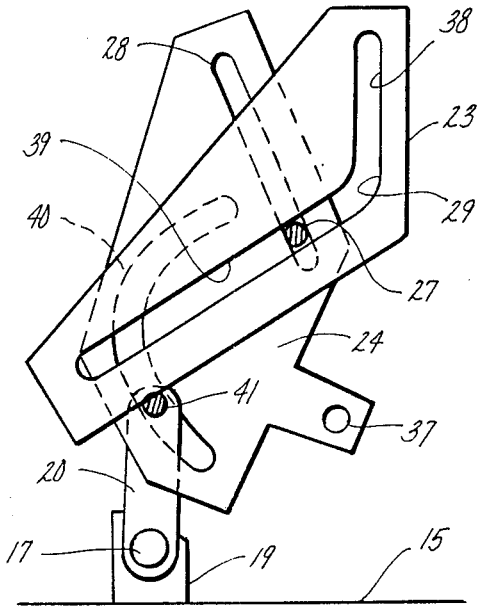

In the dwell period no significant horizontal movement of linkage assembly 10 takes place. However, as die 13 continues downwardly, cam roller 27 reaches the angular slot section 39 in fixed cam 23 and attempts to pass therealong. Cam roller 26 in cam plate 24 is hindered from moving in the direction of slot 39 because cam 24 has no similar angular slot section. Therefore, as shown in FIG. 2, as cam roller 27 reaches the curved section of slot 38 leading to section 39, the roller is forced in the direction of section 39. As a consequence cam roller 26 exerts (FIG. 3) a counterclockwise force pivoting cam plate 24 about pivot shaft 37. As cam plate 24 pivots, the wall of arcuate slot 40 engages roller 41 to rotate crank arm 20 and shaft 17, as may be seen from a comparison of FIGS. 6 and 7. Since final drive arm 21 is also fixed to shaft 17, rotation of crank arm 20 also serves to rotate drive arm 21.

Figure 8:
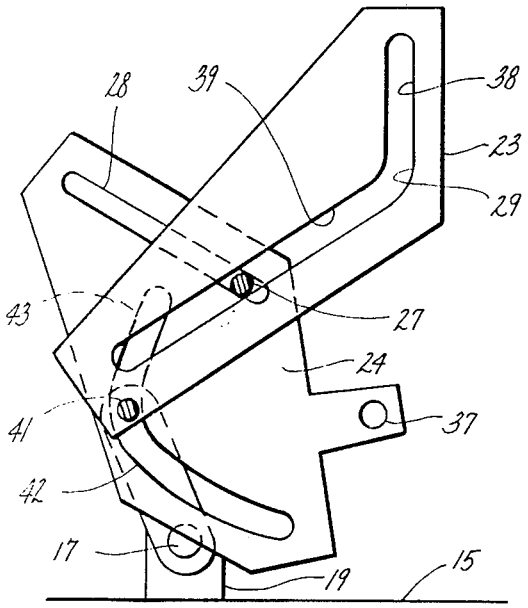
Figure 9:
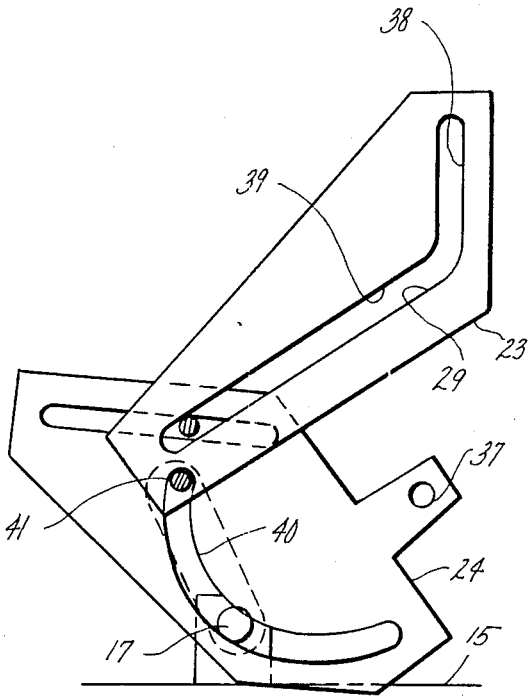

As cam plate 24 continues to pivot, roller 41/curve 40 interaction reaches a maximum for the curved slot 42. When this position is reached, the larger radius section 43 of slot 40 interacts with roller 41; FIG. 8 shows the roller just beginning to enter slot section 43. As a consequence of the larger radius, slot section 43 does not drivingly engage roller 41 and no motion of drive arm 21 occurs, i.e. the radius of section 43 rides along the length of crank arm 20. This lack of motion is a further dwell period of link assembly 10 and occurs near the lower end of the travel of die 13 towards fixed die 15. However, continued pivoting of cam plate 24 brings the end of slot 40 into engagement with cam roller 41 for additional motion of crank arm 20 and drive arm 21 for additional horizontal movement of generic link 32. FIG. 9 shows the end of slot 40 beginning to engage roller 41.

During the reverse half cycle, as die 13 commences rising from die 15, slot section 43 does not interact with roller 41 and there is no movement of crank arm 20. This establishes a dwell time proportional to the length of slot section 43. However, upon further movement of die 13, slot 42 engages roller 41 to move it and arm 20 in the clockwise direction.

During continuous operation, drive arm 21 oscillates to move a workpiece with respect to generic link arm 30 and workpiece positions 31 and 32, in a direction perpendicular to die motion 35.

Drive arm 21 may be made adjustable in length by a well known turnbuckle assembly to change the position of points 31 and 32. However, a dwell period is established at the beginning and near the end of a half cycle of die movement.

This invention provides a linkage assembly for connection to the moving die in a press apparatus which accomplishes a two-fold purpose: (1) providing transverse motion of a drive arm towards and away from the dies of the press apparatus; and (2) providing a dwell period at the beginning and end of the moving die motion.

While this invention has been disclosed and described with respect to preferred embodiments thereof, it will be appreciated by those skilled in the art that various changes and modifications thereof may be incorporated therein without departing from the spirit and scope of the invention.

Having described my invention, I claim:

1. A dual dwell incorporated linkage assembly for interconnection with a moving die of a press apparatus in which the die moves with a reciprocating motion towards and away from an opposite, fixed die, the combination comprising:

(a) an operating link arm adapted to be pivotally connected to said moving die with a free end extending towards said fixed die;

(b) a crank arm and shaft connected to said fixed die with the crank arm extending towards the free end of said operating link and adapted to oscillate with said shaft about an axis transverse to the direction of motion of said die; and (c) a dual cam assembly between said operating link arm and said crank arm to convert linear motion of said die to said oscillatory motion of said crank arm, comprising:

(1) a fixed cam plate;

(2) a pivoting cam plate;

(3) said cam plates being positioned in side-by-side parallel spaced relationship, the free end of said operating link arm being disposed between said cam plates, and said crank arm overlapping said pivoting cam plate;

(4) each of said cam plates having cam slots therein;

(5) one of said slots in said pivoting cam plate being an arcuate slot;

(6) said operating link arm having oppositely extending cam rollers thereon one of which fits into a cam slot in said fixed cam and the other of which fits into a cam slot of said pivoting cam, the movement of the cam roller in the slot of the fixed cam transmitting the configuration and direction of the slot in the pivoting cam acting on the roller of said crank arm to provide the oscillating motion of said crank arm.

2. The invention as recited in claim 1 wherein a final drive arm is fixed to the shaft of said crank arm to be driven by said crank arm and oscillate therewith.

3. The invention as recited in claim 2 wherein a transverse link is connected to said final drive arm to extend in a direction between said dies.

4. The invention as recited in claim 2, wherein said final drive arm includes means to adjust the length thereof.

5. The invention as recited in claim 2, wherein each of said cam plates includes a similar straight line slot section directly opposite and coincident with each other and whose longitudinal axes are parallel to the line of motion of said moving die towards said fixed die with opposite cam rollers on the free end of said operating link arm fitting simultaneously in said opposite straight line slots, wherefore, initial die motion of the moving die causes said operating arm to move between said cam plates and the opposite cam rollers to move in said straight line slots without imparting any movement to said pivoting-cam plate.

6. The invention as recited in claim 2, wherein the straight line slot in said fixed cam includes a slot section angularly disposed relative thereto so that the cam roller in traversing said angular slot section transmits a force through the opposite cam roller in its straight section in the pivoting cam to pivot said pivoting cam.

7. In association with a movable die (13) linearly movable along a directional path (35): the improvement comprising a first stationary cam plate (23) having a first slot that includes a first straight slot section (38) parallel to the direction of die movement, and a second slot section (39) acutely angled to the direction of die movement;

a second movable cam plate (24) rotatable around a stationary axis (at 37); said second cam plate having a second straight slot (28) extending substantially directly away from the plate rotational axis, with an inner end thereof spaced from said axis, and a third curved slot (40);

said curved slot including a first curved slot section (42) centered on a point substantially on an imaginary line extending between the plate rotational axis and the inner end of the straight slot, and a second curved slot section (43) centered on the plate rotational axis (37);

a crank arm (20) mounted for rotation around a second axis (17) in spaced parallelism to the first rotational axis;

a first cam means (26, 27) simultaneously engaged in the first and second slots;

a means (12) operated by die movement for moving the first cam means along the associaated slots;

and a second cam means (41) carried by said crank arm engaged in the third slot.

8. The improvement of claim 7 wherein the slots are sized so that when the first cam means is engaged with the straight section of the first slot the crank arm is motionless, and when the first cam means is engaged in the acutely angled section of the first slot and the second cam means is engaged in the first curved section of the third slot the crank arm is rotating, and when the first cam means is engaged in the angled section of the first slot and the second cam means is engaged in the second curved section of the third slot the crank arm is motionless, and when the first cam means is engaged in the angled section of the first slot and the second cam means is in pressure contact with the end of the second curved section of the third slot the crank arm is rotating.

9. The improvement of claim 7 wherein the second curved section of the third slot is materially shorter than the first curved section of the third slot.

10. The improvement of claim 7 wherein the radius of curvature of the second curved slot section is greater than that of the first curved slot section.

* * * * *